US005725047A

United States Patent [19]

Lopez

[11] Patent Number: 5,725,047

[45] Date of Patent: Mar. 10, 1998

[54] HEAT EXCHANGER

[75] Inventor: Robert R. Lopez, Boxford, Mass.

[73] Assignee: Lytron Incorporated, Woburn, Mass.

[21] Appl. No.: 372,631

[22] Filed: Jan. 13, 1995

[51] Int. Cl.[6] ..... F28D 1/047

[52] U.S. Cl. ..... 165/149; 165/76; 165/150; 165/152; 165/171

[58] Field of Search ..... 165/76, 144, 149, 165/150, 152, 168, 171, 183

[56] References Cited

U.S. PATENT DOCUMENTS

| | | | |
|---|---|---|---|
| 1,550,185 | 8/1925 | Steenstrup | 165/171 X |
| 2,035,403 | 3/1936 | Przyborowski | 165/171 X |
| 2,063,646 | 12/1936 | Whitesel | 165/149 X |
| 2,214,057 | 9/1940 | Hull | 165/152 X |
| 2,804,284 | 8/1957 | Otten | 165/171 X |
| 2,883,165 | 4/1959 | Jensen et al. | 165/150 |
| 2,887,564 | 5/1959 | Baran | 165/168 X |
| 3,877,518 | 4/1975 | Dreksler | 165/150 |
| 4,230,177 | 10/1980 | Berkestad | 165/76 X |
| 4,425,964 | 1/1984 | Nelson | 165/171 |
| 4,966,230 | 10/1990 | Hughes et al. | 165/150 |

*Primary Examiner*—Leonard R. Leo

*Attorney, Agent, or Firm*—Weingarten, Schurgin, Gagnebin & Hayes LLP

[57] ABSTRACT

A heat exchanger comprises a cooling frame including first and second frame portions that releasably engage fin material. In one embodiment of the heat exchanger, first and second frame portions are movable with respect to each other. A fin module, which can include fragile or pliant fin material secured to a more robust strip of material, is positionable between the first and second frame portions. A tension device, such as a spring or a spacing controller, urges the frame portions together to bind the fin module between the frame portions. Releasing tension or urging the frame portions in an opposite direction releases the fin module. The fin module can also be retained within the cooling frame with one or more clips.

26 Claims, 8 Drawing Sheets

HEAT EXCHANGER

FIELD OF THE INVENTION

The present invention relates to a heat exchanger, and more particularly to a heat exchanger having removable fin modules.

BACKGROUND OF THE INVENTION

Various manufacturing techniques and devices require heated gas to perform a process step or they produce hot gas as a byproduct of a process or device operation. When the heated gas is cooled by passing it through or near a heat exchanger, process residues can accumulate on heat transfer surfaces. Periodically, the heat transfer surfaces must be cleaned in order for the heat exchanger to function efficiently.

The heat transfer surfaces for some heat exchangers can include numerous, closely-spaced, metal fins. Although finned heat exchangers have desirable attributes, they can be particularly susceptible to fouling by viscous condensates of flux or solder produced during certain process steps of electronic device fabrication. Condensates collecting on closely spaced fins narrow and gradually block the passages between the fins, thereby reducing and ultimately precluding gas flow through the heat exchanger, thus rendering the heat exchanger inoperable.

When a heat exchanger becomes inoperable due to fouling, the manufacturing process must be suspended while the entire heat exchanger is removed and the spaces between the fins are cleared of contaminants. The ensuing down-time reduces process availability, limits production, and increases costs. Additionally, the challenge posed by removing encrustation from and between very thin aluminum fin material is daunting. Thorough mechanical cleaning, such as brushing or scraping is virtually impossible to accomplish without damaging or deforming the fin material; and cleaning the heat exchanger in a chemical bath is time consuming. Furthermore, both removal and cleaning of the heat exchanger requires specialized tools, equipment, and training.

SUMMARY OF THE INVENTION

Instead of removing an entire heat exchanger in order to clean fouled fins, the present invention provides fin modules separable from a cooling frame. In accordance with the invention, old, dirty, or otherwise ineffective fins can be easily released, without using tools, from an installed cooling frame, leaving the cooling frame and its fluid connections in place and intact. New, unclosed fins can be quickly installed, also without using tools, to return the heat exchanger to an available status in moments. Modular cooling frame portions and fin modules can be added or subtracted to configure the heat exchanger in accordance with application requirements.

In an exemplary embodiment, a heat exchanger comprises a cooling frame including first and second frame portions movable with respect to each other. A fin module, which can include fragile or pliant fin material secured to a stiffening/handling strip, is positionable between the first and second frame portions. A spacing controller secured to each of the first and second frame portions is actuatable to move the frame portions with respect to each other, thus binding the fin module between the frame portions or releasing it therefrom. Alternatively, the fin module can be retained within the cooling frame with one or more clips.

BRIEF DESCRIPTION OF THE DRAWINGS

These and further features of the invention will be better understood with reference to the accompanying specification and the drawings in which.

DETAILED DESCRIPTION OF THE INVENTION

Figure 1:
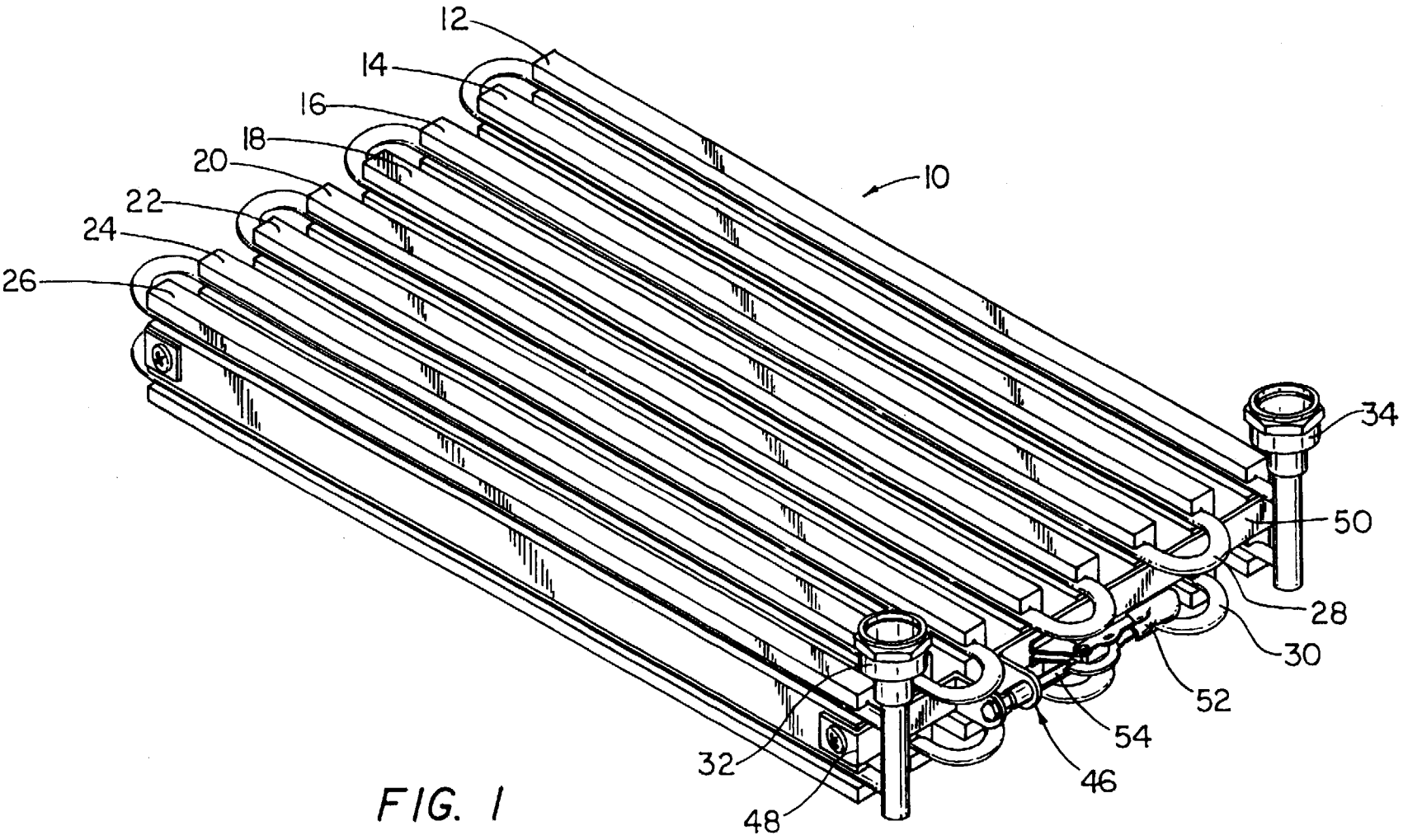
FIG. 1 is a perspective view of a heat exchanger comprising a cooling frame and fluid transmission tubes.

FIG. 1 illustrates a heat exchanger comprising a cooling frame 10 including frame portions 12, 14, 16, 18, 20, 22, 24, and 26, and fluid transmission tubes 28 and 30. Each of the tubes can be a single piece of tubing connecting a first fluid coupling 32 to a second fluid coupling 34 which can be provided for introducing and exhausting a cooling fluid into and from the fluid transmission tubes. The term "fluid" as used herein refers to a substance in a liquid or a gas phase, or a material transitioning between phases.

Figure 2:
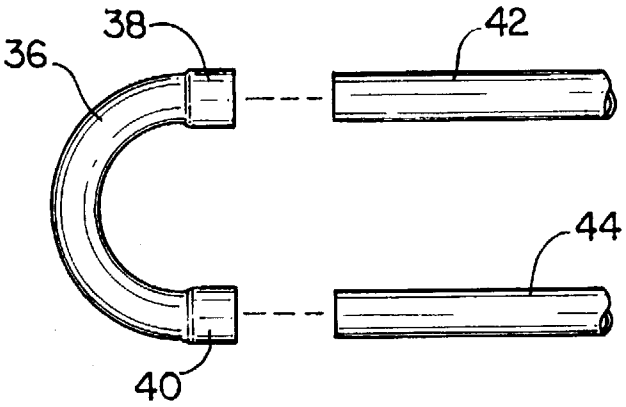
FIG. 2 is an exploded view of a tube connector and segments of a fluid transmission tube.
Figure 3:
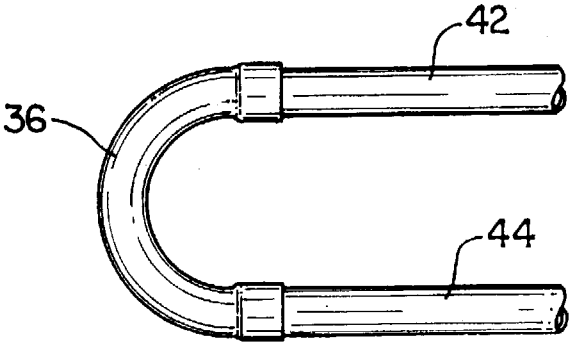
FIG. 3 illustrates the tube connector and segments of fluid transmission tube of FIG. 2 joined together.

In an alternative embodiment of the heat exchanger, the cooling frame 10 comprises two or more tube segments that are associated with two or more frame portions. The tube segments are placed in fluid communication via the tube connectors. FIG. 2 illustrates a U-shaped tube connector 36 having expanded end portions 38 and 40 adapted to receive tube segments 42 and 44, respectively. FIG. 3 illustrates the tube connector 36 joined to the tube segments 42 and 44. This embodiment of the heat exchanger provides a significant advantage to both heat exchanger manufacturers and users in that frame portions can be added or subtracted as desired to meet customer or application requirements.

In embodiments of the heat exchanger with continuous or segmented fluid transmission tubes, the tube connector 36 or the tubes 28 and 30 can be sufficiently flexible so that the connector or tubes provide a point or region of articulation for adjacent frame portions so that the frame portions can be spread apart and pushed together.

With respect to embodiments of the heat exchanger having laterally movable frame portions, the relative movement of the frame portions, and the spacing therebetween, can be affected by device that can continuously urge the frame portions together or urge them together upon actuation. In the embodiment of the heat exchanger illustrated in FIG. 1, an embodiment of such a device is a mechanical spacing controller 46 that includes a first bar 48 engagable or secured to frame portion 26, a second bar 50 engagable or secured to frame portion 12, and a lever 52 for actuating a link 54 that effects axial movement of the first bar 48 with respect to the second bar 50. A second spacing controller (not entirely shown), substantially similar to the illustrated spacing controller 46 is provided on the opposite side of the cooling frame 10 and is operated in a similar manner.

Actuation of the lever 52 to move the link 52 to a first position spreads the outer frame portions 12 and 26 apart laterally, permitting the inner frame portions 14, 16, 18, 20, 22, and 24 to move laterally with respect to each other. Conversely, actuation of the lever 52 to move the link 52 to a second position pulls the outer frame portions 12 and 26 together. Whereas FIG. 1 shows the spacing controller 46 actuated to hold the fame portions 12 and 26 in a closely spaced state, FIG. 4 illustrates the spacing controller 46 actuated to increase the spacing between the frame portions.

Although a heat exchanger comprising a cooling frame 10 alone can perform a heat exchange function well, for certain applications additional heat dissipation surface is desirable. For applications requiring a vast heat dissipation surface, the heat exchanger is provided with numerous fins inserted between adjacent frame portions of the cooling frame 10.

As used herein, a "fin" is to be understood as a heat transfer surface. Almost any metal, such as aluminum, or spun fibrous material that can be shaped to provide an extensive surface, such as by corrugation, is acceptable. However, it should be understood that performance is enhanced as material conductance is increased.

Figure 4:
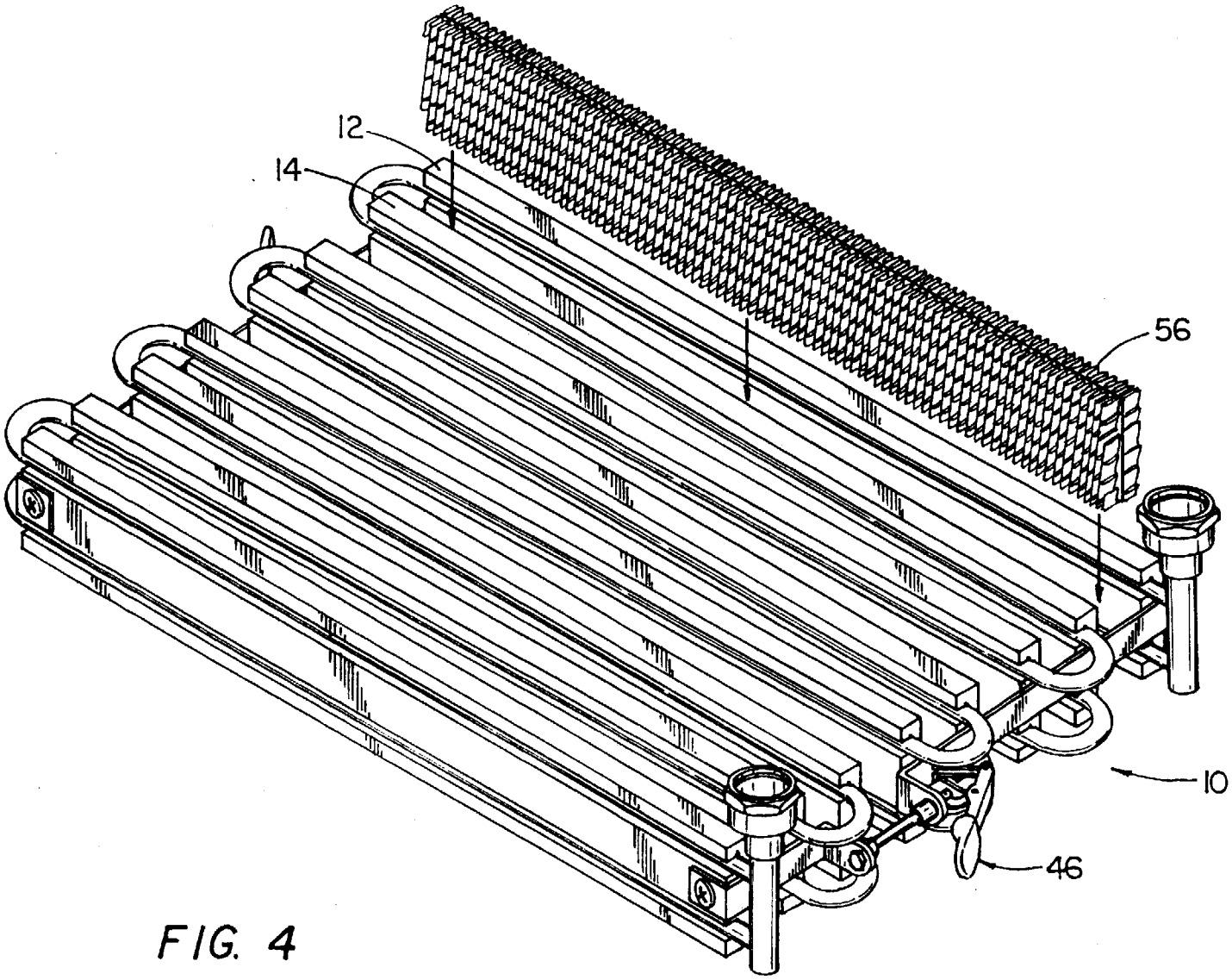
FIG. 4 is a perspective view of the heat exchanger of FIG. 1 showing the cooling frame in an unlocked state and a fin module aligned for insertion between adjacent frame portions.

FIG. 4 illustrates an embodiment of the heat exchanger having movable frame portions and a spacing controller 46. The spacing controller 46 is shown actuated to increase the spacing between all of the frame portions. The spacing controller (not shown) on the opposite side of the cooling frame 10 is similarly actuated. Fin material, having a width slightly less than the gap width between frame portions 12 and 14, is shown aligned with the gap into which it can be inserted. In this illustration, the fin material is configured as a single element or fin module 56.

Figure 5:
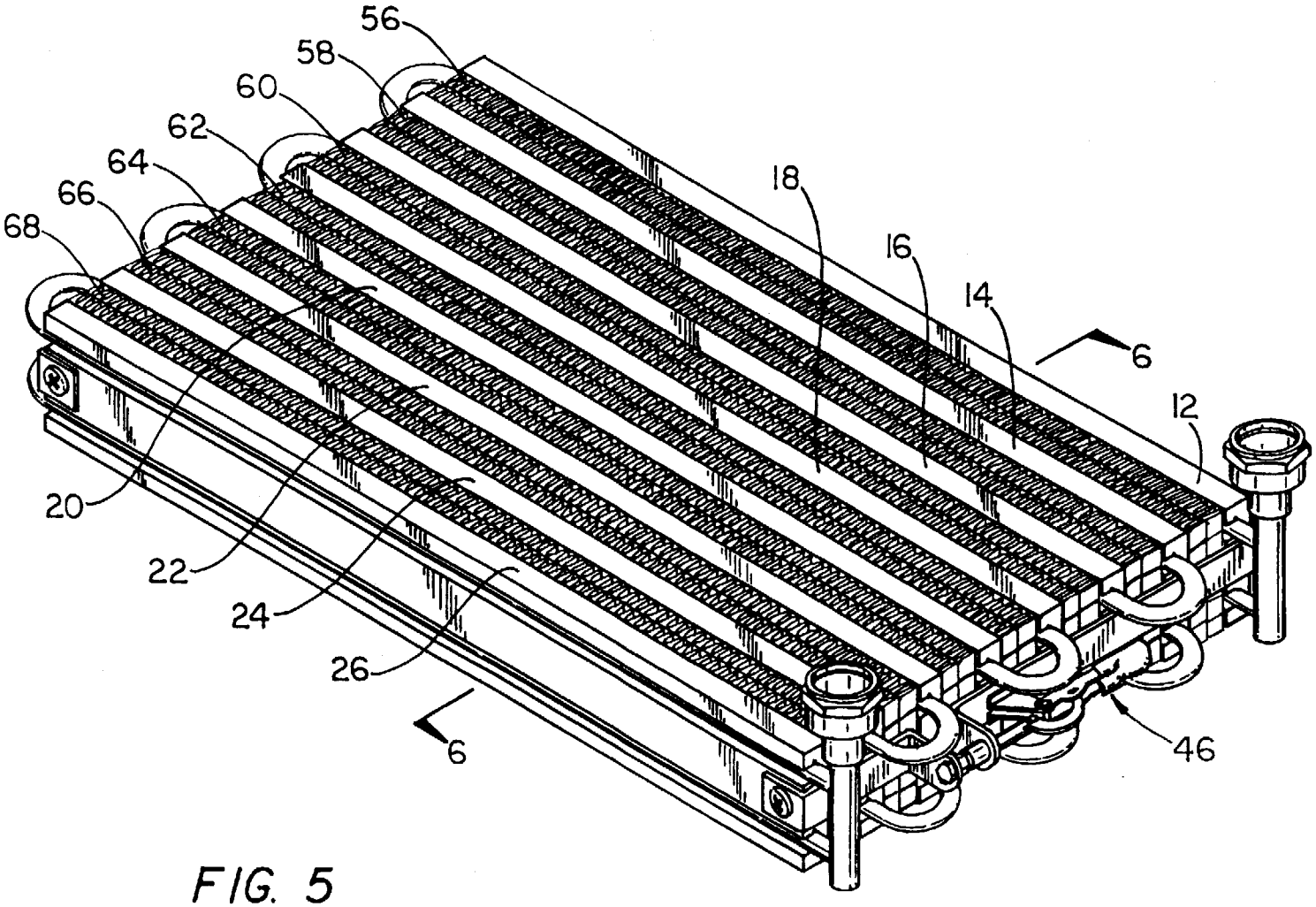
FIG. 5 is a perspective view of a heat exchanger including a cooling frame and numerous fin modules.

FIG. 5 illustrates an embodiment of the heat exchanger having substantially identical fin modules 56, 58, 60, 62, 64, 66, and 68 disposed between frame portions 12 and 14, 14 and 16, 16 and 18, 18 and 20, 20 and 22, 22 and 24, 24 and 26, respectively. The spacing controller 46 is shown actuated to decrease the spacing between all of the frame portions to a gap width less than the width of the fin modules. The spacing controller (not shown) on the opposite side of the cooling frame 10 is similarly actuated. The fin modules which are thus squeezed between the frame portions are immobilized within the cooling frame 10. Removal of the fin modules is accomplished by reversing the actuation of the spacing controller 46 to spread the frame portions apart.

Figure 6:
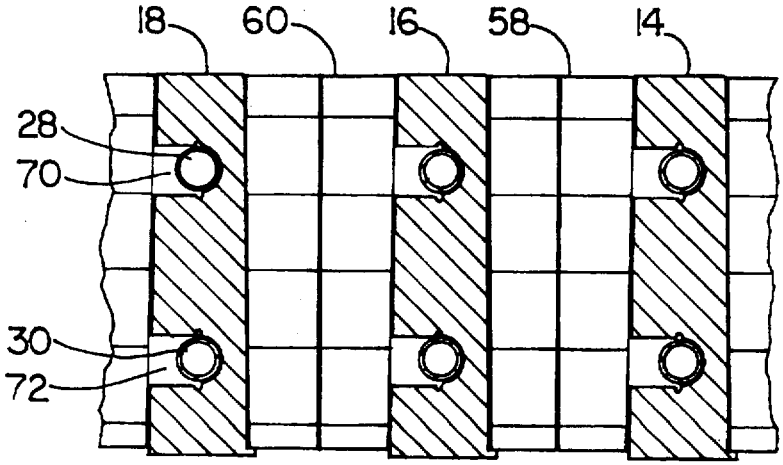
FIG. 6 is a partial sectional view of the cooling frame and fin modules of FIG. 5 taken along line 6—6.

FIG. 6 illustrates fin modules 56 and 58 pressed between frame portions 14 and 16, and 16 and 18, respectively. This cross-sectional view of the frame portion 18 illustrates an exemplary first recess 70 and a second recess 72 into which the first tube 28 and the second tube 30 are located. The tubes can be expanded or glued into place using techniques known to those skilled in the art. In one embodiment, the frame portions are fabricated from aluminum, and copper tubing is compression-fit into the recesses for optimum thermal transfer. Although FIG. 6 illustrates additional space within the recesses 70 and 72, the tubes 28 and 30 can be dimensioned to fill the their respective recess, positioned flush with the opening of the recess, or covered with a fixative to fill any remaining void.

Figure 7:
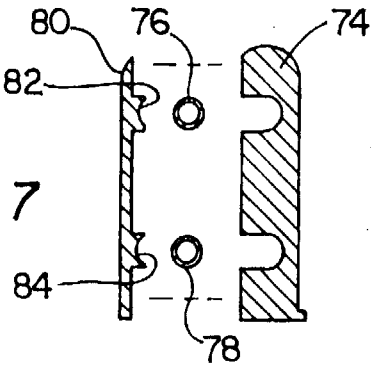
FIG. 7 is a sectional view of a frame portion and a cover plate.

FIG. 7 illustrates an embodiment of a frame portion 74 adapted to receive a first tube 76, a second tube 78, and a cover plate 80 including first and second protuberances 82 and 84 having contoured faces. Thus, either by providing a cover plate 80 or by filling the recesses as described with respect to FIG. 6, the frame portions can be provided with smooth surfaces. Smooth surfaces can contribute to insertion of frame modules, as well as facilitate the task of cleaning them if they become soiled or encrusted in use.

Figure 8:
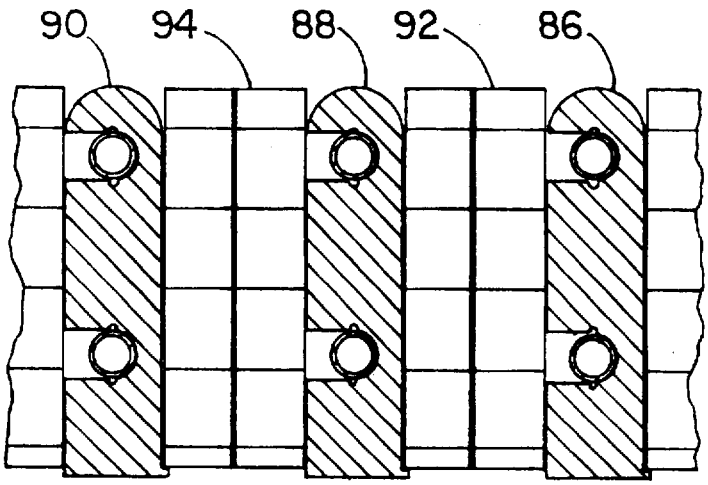
FIG. 8 is a partial sectional view of an alternative embodiment of the heat exchanger.

FIG. 8 is a partial sectional view of an alternative embodiment of the heat exchanger, wherein one face of frame portions 86, 88, and 90 is rounded or radiused. This configuration allows fin modules 92 and 94 made of a deformable material and having a width greater than the gap between frame portions to be inserted therebetween. For embodiments of the heat exchanger having movable frame portions, radiused faces act as guides for fin modules during fin module insertion. Additionally, radiused faces lower fin side pressure drop.

Figure 9:
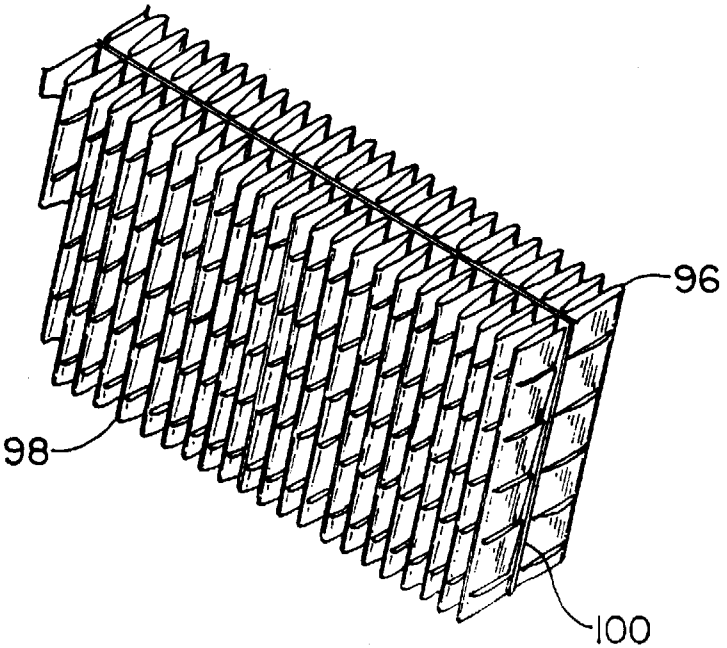
FIG. 9 is a perspective view of a portion of one embodiment of a fin module.

FIG. 9 is a perspective view of a portion of an embodiment of a fin module, wherein first and second pieces of fin material 96 and 98, respectively, are secured to a more robust material, hereafter identified as a stiffening/handling strip 100. For fin materials that are very pliant, fragile, or otherwise difficult to handle or easily damaged, the stiffening/handling strip 100 provides the fin material with a stiffness adequate to allow handling, such as during installation and removal of the of the fin module, as well as a grasping surface in some embodiments. In an exemplary embodiment of the fin module, the stiffening/handling strip 100 is metal or plastic and the fin material is corrugated, perforated aluminum that is brazed or glued to the stiffening/handling strip 100.

Figure 10:
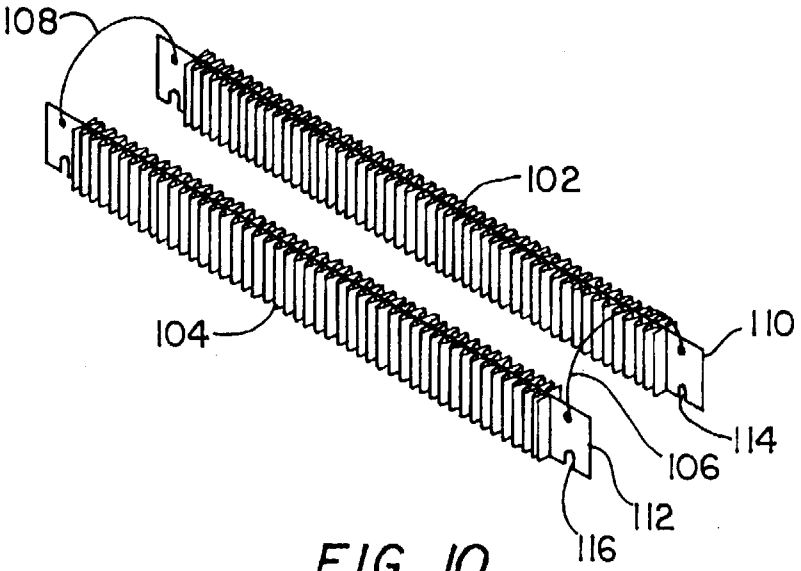
FIG. 10 is a perspective view of another embodiment of the fin module.

FIG. 10 is a perspective view of another embodiment of the fin module, wherein a first fin module 102 is joined to a similar second fin module 104 at opposing ends by handles 106 and 108. A stiffening/handling strip 110 and 112 is provided along the entire length of the fin modules 102 and 104 respectively, or at selected portions thereof, such as at the ends. The one or both ends of the stiffening/handling strips 110 and 112 can be provided with a locating feature, such as a notch 114 and 116, respectively, to assist with the installation of the fin modules into a cooling frame. The handles 106 and 108 can be flexible or have sufficient rigidity to provide the fin modules 102 and 104 with lateral spacing as required by openings in the cooling frame. The handles can be adapted for more than two fin modules as required.

Figure 11:
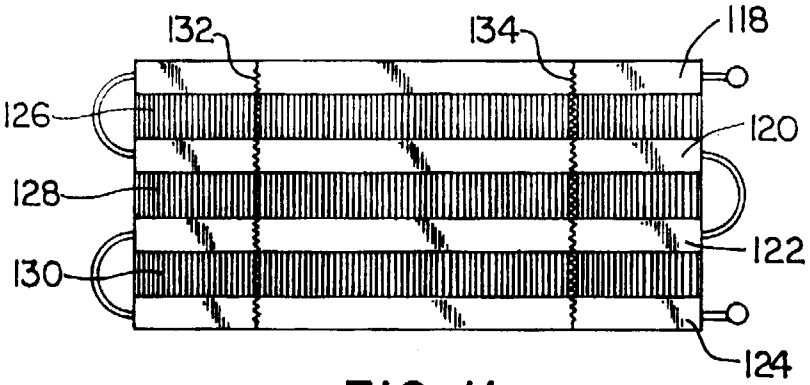
FIG. 11 is a plan view of yet another embodiment of the heat exchanger.

FIG. 11 is a plan view of yet another embodiment of the heat exchanger in which frame portions 118, 120, 122, 124 are movable with respect to each other to provide a cooling frame into which fin modules 126, 128, and 130 can be inserted. In this embodiment, in lieu of spacing controllers, tension devices such as springs 132 and 134 are provided to urge frame portion 118 toward frame portion 124, thereby squeezing all of the remaining frame portions and fin modules together to hold the fin modules in place.

Figure 12:
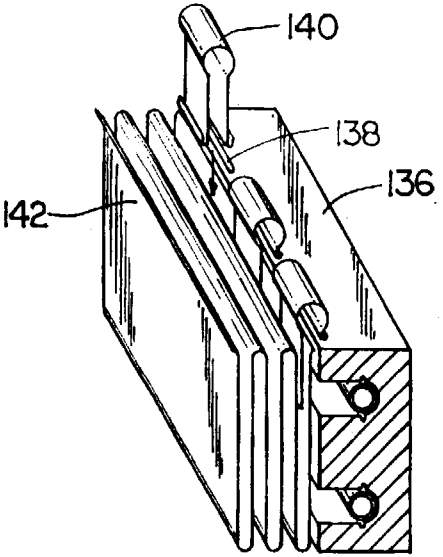
FIG. 12 is a perspective view of an alternative embodiment of the frame portion that illustrates a fin module being secured thereto.

Another embodiment of the heat exchanger is illustrated in FIG. 12, wherein a frame portion 136 includes at least one slot 138 adapted to receive a resilient clip that pinches a portion of a fin 142 against the frame portion.

The preceding description addressed features of the heat exchanger which facilitate removal and replacement of fin modules so that cleaning them is unnecessary. However, the invention also provides features which can greatly reduce or eliminate the need to clean portions of cooling frame embodiments.

Figure 13:
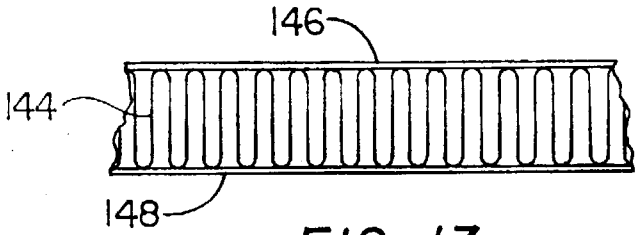
FIG. 13 is an illustration of another embodiment of the fin module.

For example, FIG. 13 illustrates an embodiment of a fin module wherein fin material 144 is sandwiched between a first and a second stiffening/handling strip, 146 and 148, respectively. Although the stiffening/handling strips 146 and 148 can be affixed to pliant, fragile, or otherwise difficult to handle fin materials for the reasons set forth with respect to FIG. 9, when this fin module is retained within a cooling frame, the abutting frame portions are covered by the stiffening/handling strips 146 and 148 to shield them from contaminants. Thus, when the fin module is removed for replacement, the previously covered frame portions are already clean. Additionally, stiffening/handling strips on the exterior of the fin module afford protection of delicate fin material during handling.

Figure 14:
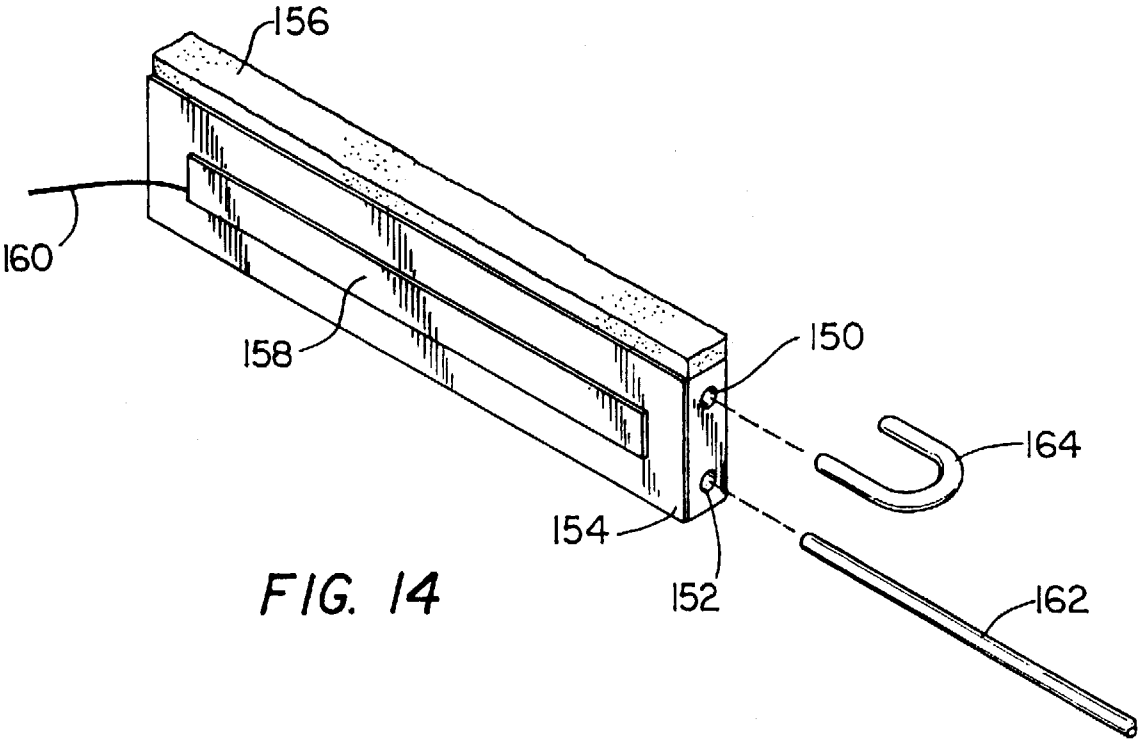
FIG. 14 is a perspective view of yet another embodiment of a frame portion.

Referring now to FIG. 14, an alternative embodiment of a frame portion is illustrated that includes features making it both more difficult to soil and easier to clean if soiled. The illustrated frame portion is a one-piece extrusion having smooth faces and integral passages 150 and 152. Smooth faces are easier to clean than textured or grooved surfaces, as described with respect to FIG. 7. Treating one or more of the surfaces with a friction reducing or non-stick material 154, such as polytetrafluorethylene, renders them even easier to clean. Insulation 156 can be applied to one or more faces of the frame portion so that the face(s) do not present a chilled surface to which some gas borne materials more readily cling.

Some embodiments of the heat exchanger under certain conditions can have encrustation of one or more of the frame portions. Materials such as resins, although difficult to remove from frame portions at room temperature are more readily wiped away at elevated temperatures. Accordingly, FIG. 14 illustrates a heating element 158, such as resistance element or a ribbon heater, applied to the frame portion for heating it. The heating element 158 has a connection 160 to a supply of electricity (not shown).

Further with respect to FIG. 14, it should be understood that a tube 162 can be inserted into the integral passage 152 to function as a passage liner. Although a single tube can be passed through more than one extruded frame portion, separate tubes can be joined with a tube connector as described with respect to FIGS. 2 and 3. Alternatively, a connector 164 can place the integral passage 150, for example, of the illustrated frame portion in fluid communication with an integral passage or tube of a second frame portion.

Although the invention has been shown and described with respect to exemplary embodiments thereof, various other changes, omissions and additions in form and detail thereof may be made therein without departing from the spirit and scope of the invention.

For example, although the present description is directed to a heat exchanger used for cooling, those skilled in the art can use the heat exchanger for heating as well. Therefore, the cooling fluid could also be a heating fluid. Also, as other techniques for cooling or heating the frame portions are contemplated, the frame portions need not be provided with tubes, and they may be simple metal, plastic, or ceramic bars or strips. Additionally, although the heat exchanger has been illustrated with straight frame portions and fin modules, these components can be curved or otherwise shaped as desired.

What is claimed is:

1. A heat exchanger comprising:

a cooling frame including a first frame portion and a second frame portion; and a fin module positionable between said first frame portion and said second frame portion;

said first frame portion being an integral extrusion having smooth side, top and bottom faces, and a passage therethrough having openings at opposing end faces.

2. The heat exchanger of claim 1, further comprising a liner within said passage.

3. The heat exchanger of claim 1, further comprising a connector tube securable to said openings.

4. The heat exchanger of claim 1, further comprising a heating device secured to said first frame portion.

5. The heat exchanger of claim 4, wherein said heating device includes a resistive element.

6. The heat exchanger of claim 4, wherein said heating device includes a ribbon heater.

7. The heat exchanger of claim 4, further comprising a non-stick surface treatment applied to said first frame portion.

8. The heat exchanger of claim 7, wherein said surface treatment includes a layer of polytetrafluorethylene.

9. The heat exchanger of claim 7, further comprising insulating material secured to said first frame portion.

10. A heat exchanger comprising:

a cooling frame including a first frame portion and a second frame portion; and a fin module positionable between said first frame portion and said second frame portion;

said fin module comprising a first fin;

a second fin;

a stiffening/handling strip between said first fin and said second fin.

11. The heat exchanger of claim 10, wherein said first fin and said second fin comprise corrugated, perforated aluminum.

12. The heat exchanger of claim 10, wherein said stiffening/handling strip includes a locating feature for aligning said fin module between said first frame portion and said second frame portion.

13. The heat exchanger of claim 12, wherein said locating feature includes a notch at one end of said stiffening/handling strip.

14. The heat exchanger of claim 12, wherein said stiffening/handling strip includes a handle secured thereto.

15. The heat exchanger of claim 12, wherein said stiffening/handling strip is longer than said first fin and said second fin.

16. The module of claim 10, wherein said stiffening/handling strip is thermally conductive.

17. A heat exchanger comprising:

a cooling frame including a first frame portion and a second frame portion; and a fin module positionable between said first frame portion and said second frame portion;

said fin module comprising a first stiffening/handling strip;

a second stiffening/handling strip; and a fin located between said first and said second stiffening/handling strip.

18. The heat exchanger of claim 17, wherein said fin comprises corrugated, perforated aluminum.

19. The heat exchanger of claim 17, wherein said first and said second stiffening/handling strip are coextensive with said fin.

20. A heat exchanger comprising:

a cooling frame including a first frame portion and a second frame portion; and a fin module positionable between said first frame portion and said second frame portion;

each said first frame portion and said second frame portion having a radiused face.

21. A heat exchanger comprising:

a cooling frame including a first frame portion and a second frame portion; and a fin module positionable between said first frame portion and said second frame portion;

said first frame portion being movable over a range of positions with respect to said second frame portion to allow insertion, removal, and securing of said fin module a corresponding positions.

22. The heat exchanger of claim 21, further comprising a tension device that urges said first frame portion toward said second frame portion.

23. A heat exchanger comprising:

a cooling frame including a first frame portion and a second frame portion;

a fin module positionable between said first frame portion and said second frame portion; and a spacing controller engagable with said cooling frame and actuatable to move said first frame portion with respect to said second frame portion.

24. A heat exchanger comprising:

a cooling frame including a first frame portion and a second frame portion; and a fin module positionable between said first frame portion and said second frame portion;

said first frame portion further including a clip adapted to engage said fin module.

25. A heat exchanger comprising:

a cooling frame including a first frame portion and a second frame portion; and a fin module positionable between said first frame portion and said second frame portion;

said first frame portion defining a recess in a face thereof, and said heat exchanger further including a fluid transmission tube located within said recess and a plate covering said recess.

26. A heat exchanger comprising:

a cooling frame including a first frame portion and a second frame portion, said first frame portion being movable with respect to said second frame portion;

a fin module including a first fin, a second fin, and a stiffening/handling strip between said first fin and said second fin to which said first fin and said second fin are secured, said fin module positionable between said first frame portion and said second frame portion; and a spacing controller engagable with said first frame portion and said second frame portion, said spacing controller actuatable to move said first frame portion with respect to said second frame portion.

* * * * *